United States Patent [19]

Graser et al.

[11] 4,032,007

[45] June 28, 1977

[54] TWO-BOTTLE BASKET CARRIER

[75] Inventors: Earl J. Graser; Jerry F. Wilson, both of Monroe, La.

[73] Assignee: Olinkraft, Inc., West Monroe, La.

[22] Filed: Oct. 19, 1976

[21] Appl. No.: 733,782

[52] U.S. Cl. ..... 206/173; 206/192; 206/427; 229/28 BC; 229/52 BC

[51] Int. Cl.² ..... B65D 75/00

[58] Field of Search ..... 206/806, 173, 192, 427; 220/21, 22, DIG. 15; 229/28 BC, 52 B, 52 BC

[56] References Cited

UNITED STATES PATENTS

| | | | |
|---|---|---|---|
| 2,311,723 | 2/1943 | Anderson | 206/427 X |
| 2,709,535 | 5/1955 | Bergstein | 229/28 BC X |
| 2,783,916 | 3/1957 | Hodapp | 206/173 X |
| 2,800,250 | 7/1957 | Buttery | 206/173 |
| 2,860,816 | 11/1958 | Fielding | 206/173 |
| 3,863,759 | 2/1975 | Prodel | 206/203 |
| 3,997,051 | 12/1976 | Graser et al. | 206/173 |

*Primary Examiner*—Robert S. Ward, Jr.
*Attorney, Agent, or Firm*—O'Brien & Marks

[57] ABSTRACT

A two-bottle carrier has an opening at one side in the bottom thereof to receive one half of a split divider post of a six-bottle shipping case. Also a center partition of the carrier is spaced from one side thereof to allow the insertion of the divider post half.

13 Claims, 11 Drawing Figures

FIG. 5
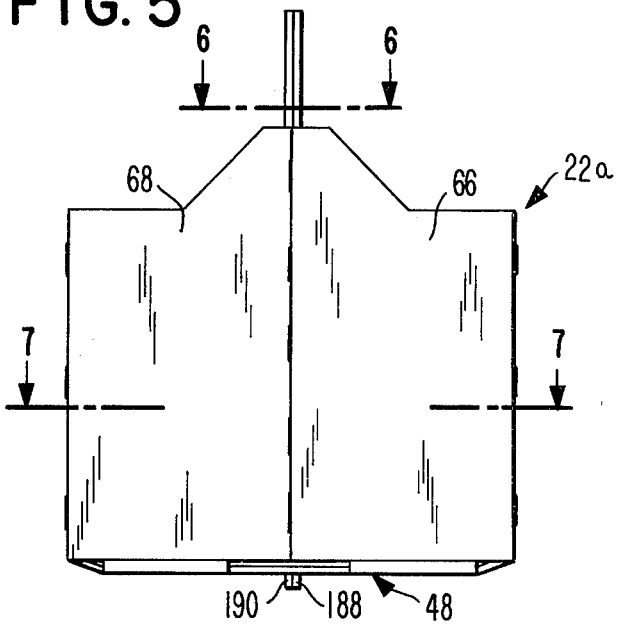
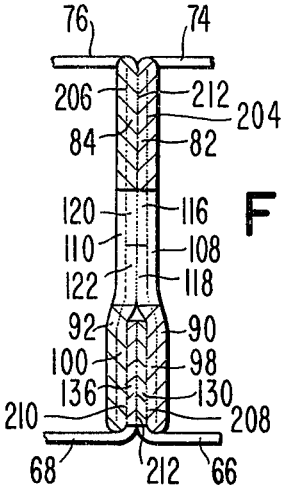
FIG. 6
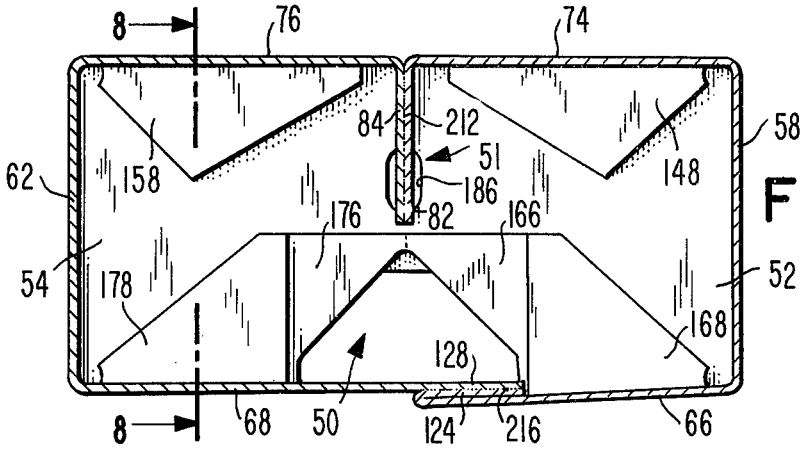
FIG. 7
FIG. 8
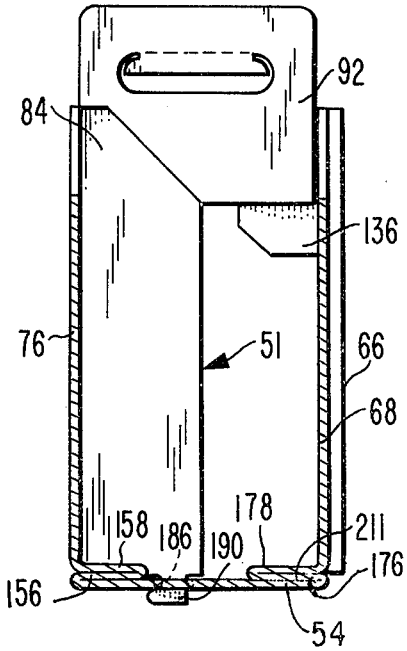

TWO-BOTTLE BASKET CARRIER

BACKGROUND OF THE INVENTION

1. Field of the Invention

This invention relates to two-bottle carriers, such as collapsible carriers, for relatively large bottles, for example one-liter beverage bottles, and particularly to carriers capable of being used in shipping cases for such bottles.

2. Description of the Prior Art

The prior art contains a number of two compartment carriers such as the collapsible carton illustrated in U.S. Pat. No. 2,800,250 which shows diagonally foldable bottom flaps hinged on the bottom edges of side walls and having tabs adhesively connected to bottom members which are hinged to the bottom edges of corresponding end walls. Similar foldable gusset panels are also illustrated in a four bottle collapsible carrier disclosed in U.S. Pat. No. 2,860,816 which also includes gusset or diagonally hinged panels between center partition walls and the bottom.

The prior art also contains many carriers wherein a hooking tab formed on the bottom edge of a center partition panel cooperates with an edge, slot, or opening in a bottom panel for holding the carton in an open or uncollapsed condition; one type of hooking tab cooperating with an oval slot extending along a fold line across the center of a bottom panel is illustrated in U.S. Pat. No. 2,783,916.

A plastic crate for shipping four "six-pack" bottle carriers is illustrated in U.S. Pat. No. 3,863,759; the crate has spacers with a star-shaped cross section projecting up from the bottom and extending through corresponding holes in the bottom of the "six-pack" carriers to prevent the bottles therein from bumping against each other during shipment.

SUMMARY OF INVENTION

The invention is summarized in a two-bottle carrier for use with a shipping case which is adapted to contain at least four bottles wherein the shipping case has at least one split divider post for separating the bottles in the case, the carrier including a pair of side walls, a pair of end walls extending between opposite ends of the pair of side walls, a bottom, the bottom having an opening midway between the end walls and adjacent one of the side walls for receiving one half of the split divider post, and a center partition extending from the other side wall and spaced from the one side wall to accommodate the one half of the split divider post between the one side wall and the center partition.

An object of the invention is to construct an improved two-bottle carrier suitable for use with a case having a split divider post for separating the bottles therein.

Another object of the invention is to provide a opening in the bottom of a carrier together with a center divider panel extending only partially across between two compartments therein to permit one half of a divider post to extend within the carrier between the two compartments.

It is also an object of the invention to design a collapsible carrier having locking features together with divider post receiving features.

One advantage of the invention is that bottles are held separate both when the carrier is in the case and when the carrier is removed from the case.

Another feature of the invention is the provision of folded gusset panels on both sides of a sling-type bottom to increase bottom strength in supporting large bottles.

Other objects, advantages and features of the invention will be apparent from the following description of the preferred embodiment taken in conjunction with the accompanying drawings.

BRIEF DESCRIPTION OF THE DRAWINGS

FIG. 5 is an elevational view taken from the left side of the carrier of FIG. 3.

FIG. 6 is a cross-section view taken along the line 6—6 in FIG. 5.

FIG. 7 is a cross-section view taken along the line 7—7 in FIG. 5.

FIG. 8 is a cross-section view taken along the line 8—8 in FIG. 7.

DESCRIPTION OF THE PREFERRED EMBODIMENT

Figure 1:
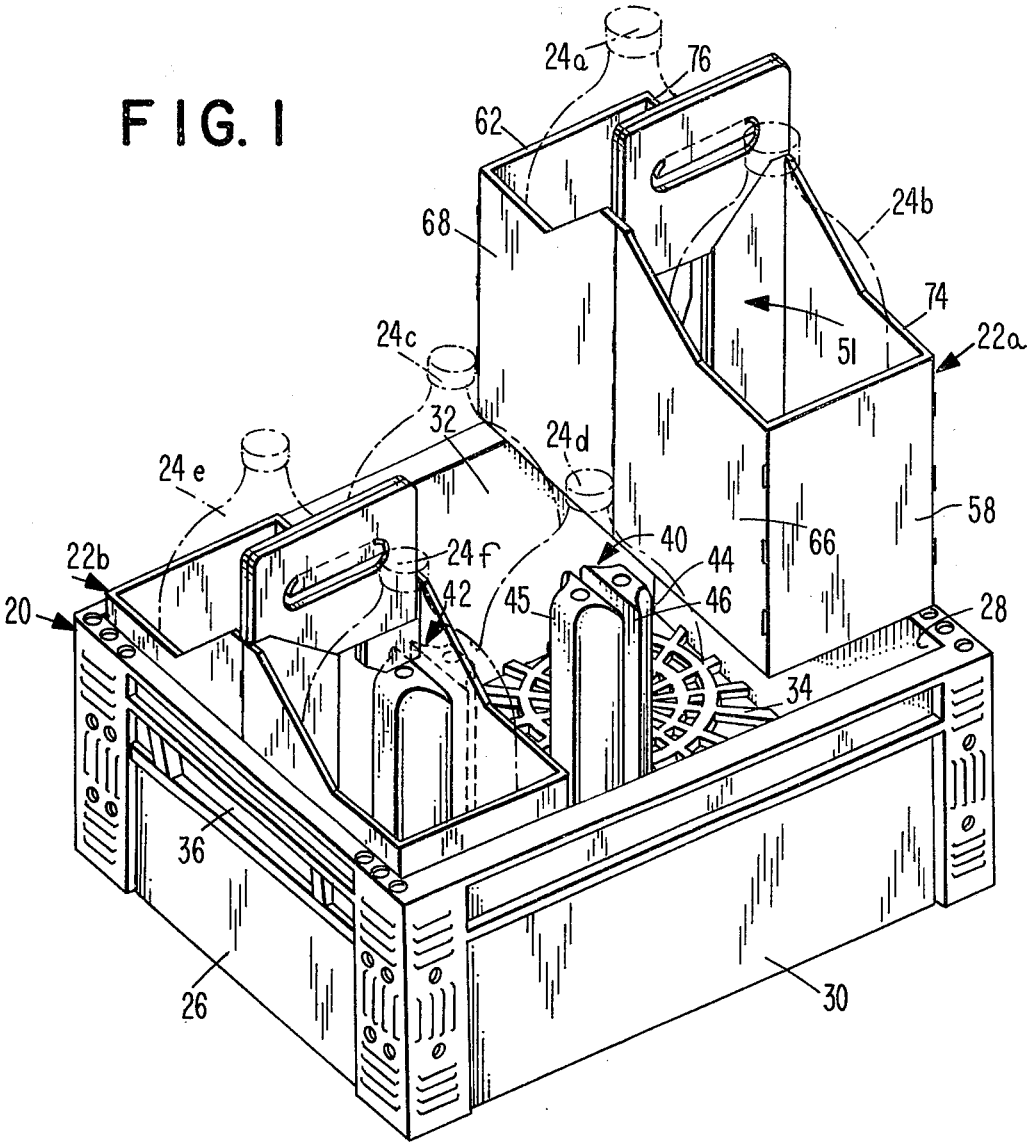
FIG. 1 is a perspective view taken from the upper left front corner of a case with carriers, one carrier shown in a raised position, in accordance with the invention.

As illustrated in FIG. 1, the invention is embodied in a case indicated generally at 20 with two carriers indicated generally at **22*a* and 22*b* for containing respective pairs of a plurality of bottles such as six beverage bottles 24*a*, 24*b*, 24*c*, 24*d*, 24*e* and 24*f*. The carriers 22*a* and 22*b* are positioned in opposite ends of the case 20 to receive the respective bottles 24*a*, 24*b*, 24*e* and 24*f* while the bottles 24*c* and 24*d* are received in a central portion of the case 20 between carriers 24*a* and 24*b***.

Figure 2:
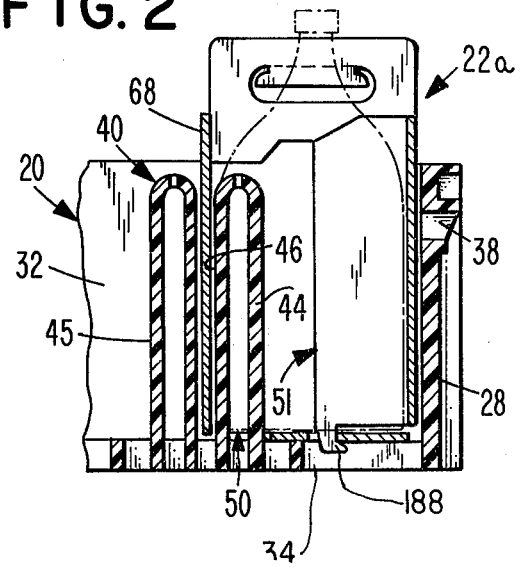
FIG. 2 is a front elevational cross-section view taken along the centerline of a broken-away portion of the case and one carrier of FIG. 1.

The case 20 is made of a molded polymer resin and has a left end wall 26, a right end wall 28, a front side wall 30, a back side wall 32 and a web-like bottom 34. Handle openings 36 and 38, FIG. 2 are formed in the respective end walls 26 and 28. A divider post indicated generally at 40 is integrally formed with the bottom 34 and protrudes upward within the case 20 for separating the bottles **24*a*, 24*b*, 24*c* and 24*d*; similarly a divider post indicated generally at 42 is integrally molded with the bottom 34 and protrudes upwardly to separate the bottles 24*c*, 24*d*, 24*e* and 24*f*, the divider post 42 being substantially identical to the divider post 40. The divider post 40 is split or formed from two halves 44 and 45 defining a vertical slot 46 therebetween. The slot 46 extends in a vertical plane perpendicular to the front and back walls 30 and 32 and parallel to the end walls 26 and 28. Each of the halves 44 and 45** have a generally triangular horizontal cross-section with suitable contoured surfaces for engaging the bottles 24*a*, 24*b*, 24*c* and 24*d*. Although the case 20 is illustrated as being formed from molded plastic, other types of cases having split divider posts, such as cases formed from wire, wood, and the like, could also be employed.

Figure 3:
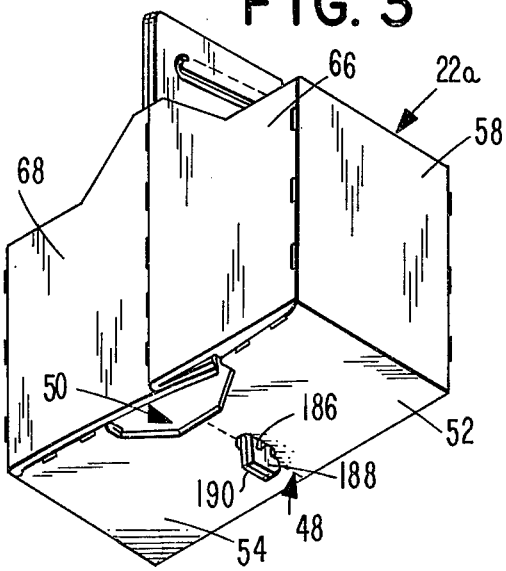
FIG. 3 is a perspective view taken from the bottom left front corner of one carrier of FIG. 1.

The carriers 22*a* and 22*b* are identical except that the carrier 22*b* is rotated 180° about a vertical axis relative to the carrier 22*a;* thus for sake of brevity only the carrier 22*a* is described in detail. As shown in FIGS. 1–3, the carrier 22*a* includes a bottom indicated generally at 48 which includes an opening indicated generally at 50 midway between the front and back ends of the carrier 22*a* and adjacent the left side of the carrier. The opening 50 is generally triangular in shape to receive the divider post half 44. Also the carrier 22*a* includes a center partition indicated generally at 51 which extends from the right side of the carrier only partially across the carrier, for example a little over one-half the distance across the carrier, between the front and back compartments of the carrier so as to form a partition separating the bottles 24*a* and 24*b* while leaving adequate space at the left side between the front and back compartments to receive the divider post half 44.

Figure 4:
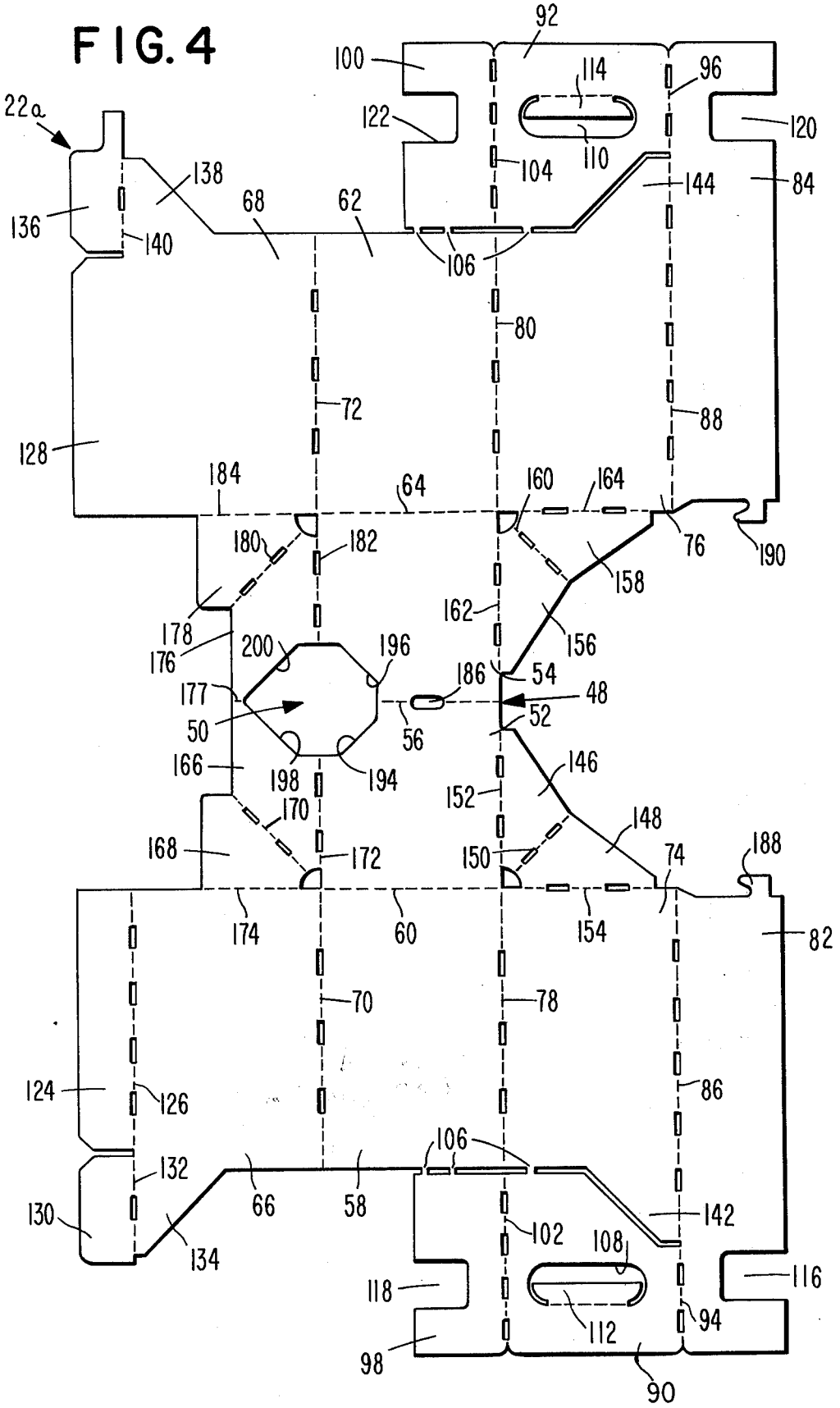
FIG. 4 is a plan view of a blank for forming the carrier of FIG. 3.

As shown in FIG. 4, the carrier 22*a* is formed from a blank cut from a sheet of paperboard, cardboard, or other material suitable for use in carriers for bottles and the like. The blank includes a pair of front and back bottom panels 52 and 54, respectively, hinged together at a center score line 56 to form the bottom 48. A front end panel 58 at the bottom edge thereof is hinged at a score line 60 to the front edge of the bottom panel 52 while a back end panel 62 at its bottom edge is hinged at a score line 64 to the back edge of the panel 54. Left side panels 66 and 68 are hinged at respective perforated score lines 70 and 72 on their respective front and back edges to the left side edges of the front and back end panels 58 and 62. Similarly, front and back right side panels 74 and 76 are hinged at their front and back edges, respectively, along perforated score lines 78 and 80 to the right edges of the front and back end panels 58 and 62. Center partition panels 82 and 84 are hinged at perforated score lines 86 and 88 on the respective inside edges of the right side panels 74 and 76. At top handle portions of the center partition panels 82 and 84, outside handle panels 90 ane 92 are hinged along respective score lines 94 and 96 to right side edges of the partition panels 82 and 84, while at left side edges of the outside handle portions 90 and 92, inner handle panels 98 and 100 are hinged along respective perforated score lines 102 and 104. Temporary ties 106 connect the panels 90 and 92 to the respective panels 74 and 76 and connect the panels 98 and 100 to the panels 58 and 62; such temporary ties are torn or severed during the folding of the blank into the carrier 22*a* of FIGS. 1–3 and only aid in handling and processing of the blank prior to such folding. The outside handle panels 90 and 92 contain finger openings 108 and 110 with bendable strengthing flaps 112 and 114 hinged at the top of the openings 108 and 110. Openings 116 and 118 are formed in the top handle portion of partition panel 82 and in the inside handle portion 98, respectively, for forming an opening communicating with the opening 108 when the inner edges of the panel 98 and the top portion of the panel 82 are brought into substantial abutment during the folding of the carrier; similarly an opening 120 in the top handle portion of the center partition panel 84 and an opening 122 in the inside handle panel 100 are provided for allowing complete communication between the openings 108 and 110 when the carrier is folded into its assembled condition.

On the front left side panel 66, a joint flap 124 is hinged along a perforated score line 126 at an inner edge thereof, while on the back left side panel 68, an unhinged extending portion 128 extends beyond the center line of the left side of the carrier 22*a* as would be defined by a vertical upward extension of line 126 across the panel 68. A handle securing tab 130 is hinged at a perforated score line 132 along the inner edge of an upper triangular portion 134 of the front left side panel 66. A similar handle securing tab 136 is hinged on an upper triangular extension 138 of the back left side panel 68 along a perforated score line 140. It is noted that the right side panels 74 and 76 have respective upper triangular extensions 142 and 144 similar to the triangular extensions 134 and 138.

A pair of right front gusset or bellows panels 146 and 148, hinged at a diagonal perforated score line 150 to each other, are formed between the right side edge of the bottom panel 52 and the bottom edge of the front right side panel 74; the panel 146 being hinged at a perforated score line 152 to the bottom panel 52 while the panel 148 is hinged at a perforated score line 154 to the side panel 74. Similarly right back gusset or bellows panels 156 and 158 are formed between the bottom panel 54 and the side panel 76; the panels 156 and 158 being hinged together at a diagonal perforated score line 160 with the panel 156 being hinged at a perforated score line 162 to the right side edge of the panel 54 and the panel 158 being hinged at a perforated score line 164 to the bottom edge of the back right side panel 76. On the left side, a pair of front gusset or bellows panels 166 and 168 are hinged together at a diagonal perforated score line 170 with the panel 166 being hinged to the left side edge of the bottom panel 52 at a perforated score line 172 and with the panel 168 being hinged at a score line 174 to the bottom edge of the front left side panel 66; similarly, back gusset or bellows panels 176 and 178 are formed between the bottom panel 54 and the left panel 68 with the panels 176 and 178 being hinged together at a perforated score line 180, with the panel 176 being hinged to the left side edge of the bottom panel 54 at a perforated score line 182 and with the panel 178 being hinged at a score line 184 to the bottom edge of the left side panel 68. The panels 166 and 176 are hinged together at score line 177.

An oval opening 186 is provided in bottom panels 52 and 54 extending longitudinally along the score line 56. Locking tabs 188 and 190 are formed on the bottom edges of the center partition panels 82 and 84, respectively. The locking tabs 188 and 190 are located to mate and lock with the opening 186.

The opening 50 in the bottom 48 formed by the bottom panels 52 and 54 includes respective notches or recesses 194 and 196 cut into the rear left corner of the panel 52 and front left corner of the panel 54, respectively. The gusset panels 166 and 176 have similar recesses 198 and 200 for corresponding with the notches or recesses 194 and 196 when the gusset panels 166 and 176 are folded over the bottom panels 52 and 54.

As shown in FIGS. 5, 6, 7 and 8 wherein the carrier is assembled and in the open condition, the outer handle panel portion 90 is secured to the upper portion of the center partition panel 82 and to the inner handle panel 98 by adhesive 204 (shown as dotted line) while the outer handle panel 92 is secured to the upper portion of the center partition panel 84 and to the inner handle panel 100 by adhesive 206. The handle securing tabs 130 and 136 are glued to the inside surfaces of the inner handle panels 98 and 100 by adhesive 208 and 210, respectively. The gusset panels 166 and 176 are fixed to the respective bottom panels 52 and 54 by adhesive 211, the gusset panels 168 and 178 being folded on top of the panels 166 and 167 respectively. A front handle portion formed by the outer handle panel 90 secured to the upper portion of the center partition panel 82 and to the inner handle panel 98 with the tab 130 secured thereto is glued or fixed by adhesive 212 to a back handle portion formed by the outer handle panel 92 secured to the top portion of the center partition panel 84 and to the inner handle panel 100 with the tab 136 attached thereto. The adhesive 212 extends downward along the inside surfaces of the inside divider panels 82 and 84 securing then together throughout their length to form the center partition 51. The joint flap 124 is secured to the extension 128 of the panel 68 by adhesive 216. The panels 66 and 68 form one side wall of the carrier while the panels 74 and 76 form the other side wall.

Also in the open condition, the gusset panels 156 the 158 are folded together to extend inside the back compartment of the carrier over the back bottom panel 54; the gusset panels 146 and 148 similarly being folded inside of the front compartment over the front bottom panel 52. The hook portion of locking tabs 188 and 190 extends through the opening 186 and engages the bottom surface of the bottom panels 54 and 52 along the score line 56 to hold the carrier in the open condition.

Figure 9:
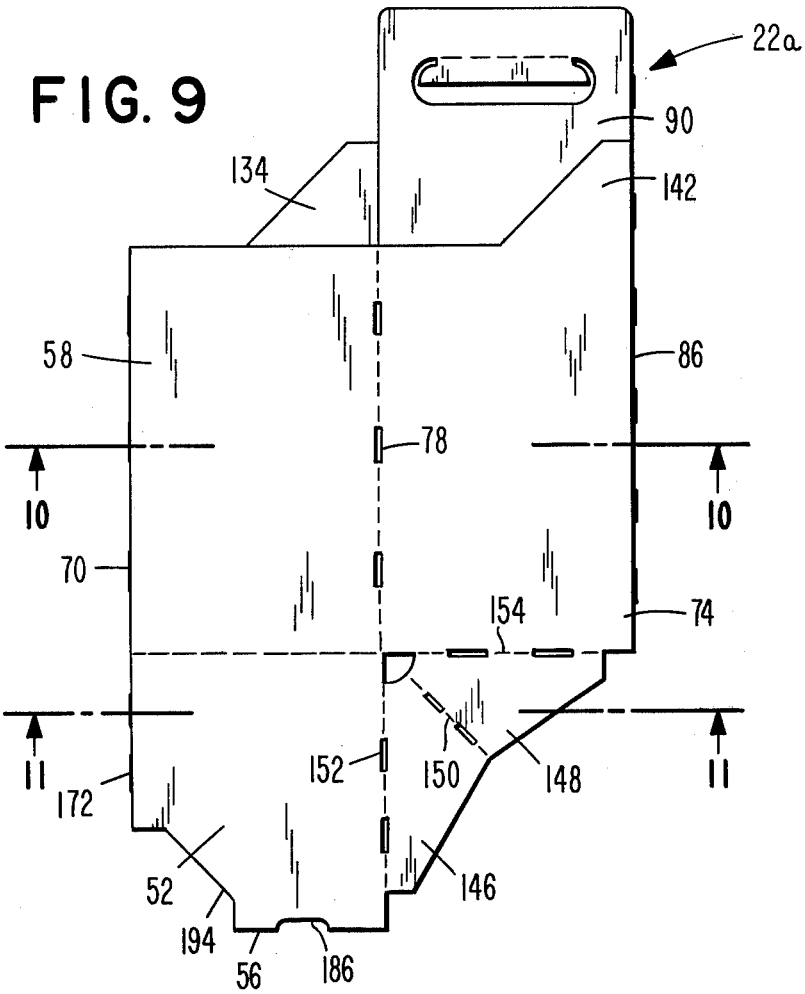
FIG. 9 is a plan view of the carrier of FIG. 3 in a folded or collapsed condition.
Figure 10:
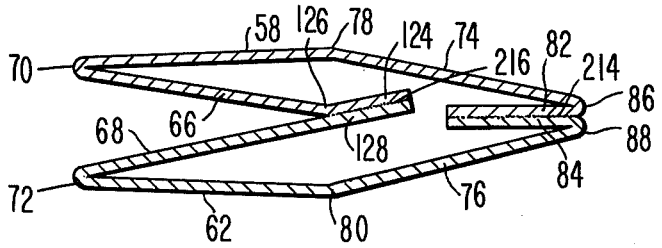
FIG. 10 is a cross-section view taken along the line 10—10 in FIG. 9 with the carrier in a partially unfolded condition.
Figure 11:
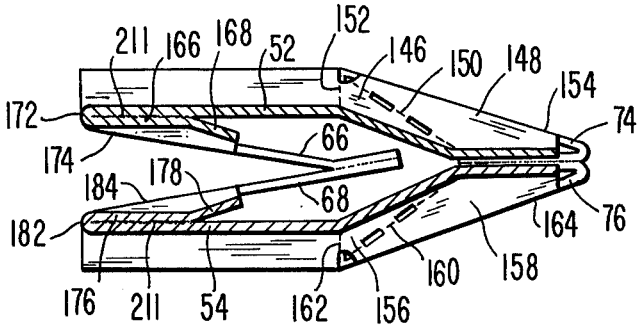
FIG. 11 is a cross-section view taken along the line 11—11 in FIG. 9 with the carrier in condition similar to FIG. 10.

The carrier can be collapsed and folded by releasing the locking tabs 188 and 190 from the opening 186 and then folding as illustrated in FIGS. 9, 10 and 11. In the folded condition, the pair of gusset panels 166 and 168 are unfolded and the pair of gusset panels 176 and 178 are unfolded; these unfolded pairs of gusset panels together with the left side panels 66 and 68 are folded face-to-face inside the carrier with the bottom panels 52 and 54 folded about the hinge 56 outside of the respective unfolded pairs of gusset panels and with the end panels 58 and 62 collapsed on the outside of the left side panels 66 and 68. The pair of gusset panels 146 and 148 and the pair of gusset panels 156 and 158 are unfolded outside while the right side panels 74 and 76 are bent further about the hinges 86 and 88 to sandwich the center partition panels 82 and 84 therebetween.

The carrier 22*a* is in its folded condition when not carrying bottles so that it can be shipped or stored in a minimum space. The carrier can be easily opened an locked in the open or unfolded condition to receive and carry bottles.

It is noted that the opening 50 in the left side of the bottom 48 midway between the ends of the bottom 48 as well as the center partition 51 formed by the glued panels 82 and 84 extending only partially across the center of the carrier from the right side permits the divider post half 44 of the split divider post 40 to be received inside the carrier along the inside of the panel 68 and the folded joint flap 124. The slit 46 between the divider halves 44 and 45 is sufficiently wide to receive the panel 68 together with the panel 66 and folded joint flap 124. Thus, the carrier 22*a* can be used with the case 20 carrying six bottles and the carrier can be removed therefrom carrying two bottles; in both instances the bottles are held apart, in the first instance by the post 40 and in the second instance by the partition 51.

Further the case 20 has a bottom 34 which includes interstices in the bottom 34 to receive the hook tabs 188 and 190; thus the tabs 188 and 190 are not readily bent and rendered useless or difficult to use.

It is also noted that the bottom 48 of the carrier 22*a* is a sling-type bottom secured at the front and back ends to the front and back end panels 58 and 62 and there are included four bellows or gusset arrangements secured to the respective four side panels 66, 68, 74 and 76 and folded inside of the carrier to extend over the respective left and right portions of the bottom panels 52 and 54; such arrangement of four bellows panels overlying the bottom 48 provides substantial reinforcement to the bottom of the carrier and reduces the tendency of the carrier to rip or tear at the bottom due to the weight of the bottles and their contents.

Since the present invention is subject to many modification, variations and changes in detail, it is intended that all matter in the foregoing description or shown in the accompanying drawings be interpreted as illustrative and not in a limiting sense.

What is claimed is:

1. A two-bottle carrier for use with a shipping case which is adapted to contain at least four bottles wherein the shipping case has at least one split divider post for separating the bottles in the case, the carrier comprising a pair of side walls, a pair of end walls extending between opposite ends of the pair of side walls, a bottom, said bottom having an opening midway between the end walls and adjacent one of the side walls for receiving one half of the split divider post, and a center partition extending from the other side wall and spaced from the one side wall to accommodate the one half of the split divider post between the one side wall and the center partition.

2. A two-bottle carrier as claimed in claim 1 wherein the bottom is formed by a pair of bottom panels hinged together at a center line, the pair of bottom panels are hinged at front and back edges to the bottom edges of the pair of end walls, the pair of side walls are each formed by front and back hinged side wall panels, the bottom has a second opening along the hinge between the pair of bottom panels, and the carrier includes a hook tab extending downward from the center partition for extending through the second opening in the bottom to engage the bottom and hold the carrier in an open position.

3. A two-bottle carrier as claimed in claim 2 including four pairs of diagonally hinged gusset panels, one panel of each of said four pairs of gusset panels being connected to the respective side wall panels while the other panels of the four pairs of gusset panels are connected to respective side edges of the respective bottom panels, said four pairs of gusset panels extending over the bottom panels to reinforce the same.

4. A two-bottle carrier as claimed in claim 3 wherein the other panels of the two pairs of gusset panels connected to one of the pair of side walls are glued to the bottom panels.

5. A two-bottle carrier as claimed in claim 2 including a joint flap hinged on one of the front and back side wall panels of one side wall of the pair of side walls; and the other of the front and back side wall panels of the one side wall having an extension extending over the respective other side wall panel, said joint flap being glued to the extension.

6. A two-bottle carrier as claimed in claim 1 including handle means on an upper portion of the center partition.

7. A two-bottle carrier as claimed in claim 1 wherein the carrier is formed from paperboard.

8. A collapsible two-compartment carrier comprising a bottom formed by front and back bottom panels hinged together at a center line;

front and back end wall panels hinged on the front and back edges, respectively, of the bottom;

right and left front side wall panels hinged on the right and left side edges, respectively, of the front end wall panel;

right and left back side wall panels hinged on the right and left side edges, respectively, of the back end wall panel;

means joining the right front and right back side wall panels and joining the left front and left back side wall panels at inside edges thereof;

partition means for at least partially separating the space within the side wall panels and end wall panels into front and back compartments;

handle means formed on top of the partition means;

four pairs of gusset panels, each pair hinged together at a diagonal score line;

one gusset panel of each pair of gusset panels hinged to the bottom edge of a corresponding side wall panel of the right front, left front, right back and left back side wall panels; and the other panel of each pair of gusset panels hinged to a corresponding edge of the right and left side edges of the front and back bottom panels.

9. A multiple-bottle shipping arrangement for at least four bottles comprising a case having a bottom, four side walls, and at least one split divider post for separating the bottles in the case; and a pair of two-bottle carriers in the case, each carrier having a pair of side walls, a pair of end walls extending between opposite ends of the pair of side walls, a bottom, said bottom having an opening midway between the end walls and adjacent one of the side walls for receiving one half of the split divider post, and a center partition extending from the other side wall and spaced from the one side wall to accommodate the one half of the split divider post between the one side wall and the partition.

10. A shipping arrangement as claimed in claim 9 wherein each carrier is collapsible and has a sling-type bottom and a locking tab for engaging the bottom to hold the carrier open, and wherein the bottom of the case has interstices for receiving the locking tab.

11. A two-bottle integral carrier blank for assembly into a carrier adapted to be received in a shipping case for at least four bottles wherein the shipping case has at least one split divider post, the blank comprising bottom means, two side wall means, two end wall means, and center partition means hinged together and adapted to be assembled into a two-bottle carrier, said bottom means having an opening on one side thereof midway between ends thereof for receiving one half of the split divider post when the blank is assembled into a carrier, and said center partition means including partition panel means for extending only partially across the center of the carrier so as to permit the one half of the split divider post to be received inside the carrier to one side of the partition panel means.

12. A blank as claimed in claim 11 including for pairs of internally foldable gusset means hinged on side edges adjacent respective four corners of the bottom means.

13. A blank as claimed in claim 11 including handle means.

* * * * *

UNITED STATES PATENT OFFICE

CERTIFICATE OF CORRECTION

PATENT NO. : 4,032,007

DATED : June 28, 1977

INVENTOR(S) : Earl J. Graser, Jerry F. Wilson

It is certified that error appears in the above-identified patent and that said Letters Patent are hereby corrected as shown below:

Column 1, line 57, delete "a" and insert in place thereof -- an --.

Column 3, line 46, delete "ane" and insert in place thereof -- and --.

Column 3, line 59, delete "strengthing" and insert in place thereof -- strengthening --.

Column 5, line 21, delete "then" and insert in place thereof -- them --.

Column 5, line 27, after 156 delete "the" and insert in place thereof -- and --.

Column 6, line 22-23, delete "modification" and insert in place thereof -- modifications --.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*